US007115003B2

(12) United States Patent
Zhao et al.

(10) Patent No.: US 7,115,003 B2
(45) Date of Patent: Oct. 3, 2006

(54) ELECTRICAL TERMINAL SOCKET ASSEMBLY INCLUDING BOTH T SHAPED AND 90° ANGLED AND SEALED CONNECTORS

(75) Inventors: Weiping Zhao, Canton, MI (US); Duane I. Mikkola, South Lyon, MI (US)

(73) Assignee: Alcon Fujikura Limited, Franklin, TN (US)

( * ) Notice: Subject to any disclaimer, the term of this patent is extended or adjusted under 35 U.S.C. 154(b) by 0 days.

(21) Appl. No.: 11/085,932

(22) Filed: Mar. 21, 2005

(65) Prior Publication Data

US 2005/0164566 A1 Jul. 28, 2005

Related U.S. Application Data

(62) Division of application No. 09/951,012, filed on Sep. 14, 2001, now Pat. No. 6,875,063.

(60) Provisional application No. 60/271,776, filed on Feb. 27, 2001, provisional application No. 60/232,698, filed on Sep. 15, 2000.

(51) Int. Cl.
*H01R 11/22* (2006.01)

(52) U.S. Cl. ..... 439/851; 29/869

(58) Field of Classification Search ..... 439/851, 439/846, 884, 787, 877–878, 842–843; 29/868–869, 29/871–873, 881, 876; 174/77 R, 84 C, 174/74 R, 80
See application file for complete search history.

(56) References Cited

U.S. PATENT DOCUMENTS 3,218,606 A * 11/1965 Schultz ..... 439/844
4,128,293 A * 12/1978 Paoli ..... 439/843
4,445,747 A * 5/1984 Neidich ..... 439/787
4,550,972 A * 11/1985 Romak ..... 439/839
4,657,335 A * 4/1987 Koch et al. ..... 439/851
4,734,063 A * 3/1988 Koch et al. ..... 439/844
5,775,960 A * 7/1998 Saito et al. ..... 439/843
5,921,822 A * 7/1999 Kennedy, deceased et al. ..... 439/851
5,925,852 A * 7/1999 Hinz et al. ..... 174/65 R
5,987,745 A * 11/1999 Hoglund et al. ..... 29/869
6,017,253 A * 1/2000 Schramme ..... 439/851
6,062,919 A * 5/2000 Trafton ..... 439/843
6,186,841 B1 * 2/2001 Jacobsson ..... 439/851
6,254,439 B1 * 7/2001 Endo et al. ..... 439/843
6,425,786 B1 * 7/2002 Scholler ..... 439/843
6,482,049 B1 * 11/2002 Swearingen ..... 439/843
6,520,998 B1 * 2/2003 Scholler et al. ..... 439/851
6,658,735 B1 * 12/2003 Ito ..... 29/868

* cited by examiner

*Primary Examiner*—J. F. Duverne
(74) *Attorney, Agent, or Firm*—Greenberg Traurig LLP; Harry A. Hild, Jr.

(57) ABSTRACT

A terminal socket assembly for interconnecting electrically powered vehicular components with an associated input male input pin and an output cable. The socket assembly includes a spring cage blank having first and second extending edges and a plurality of spaced apart and angled beams extending between the edges. The spring cage is formed into a substantially cylindrical shape, and particularly in an "hourglass shape". A substantially tubular sleeve is provided for receiving the configured spring cage. The sleeve is compressingly engageable. The assembled sleeve and spring cage is capable of biasingly receiving and engaging an extending and inserting portion of the male pin. Gripping portions are integrally secured to the tubular sleeve and fixedly engage an extending end of a cable to electrically communicate the two cables.

8 Claims, 8 Drawing Sheets

FIG-3B
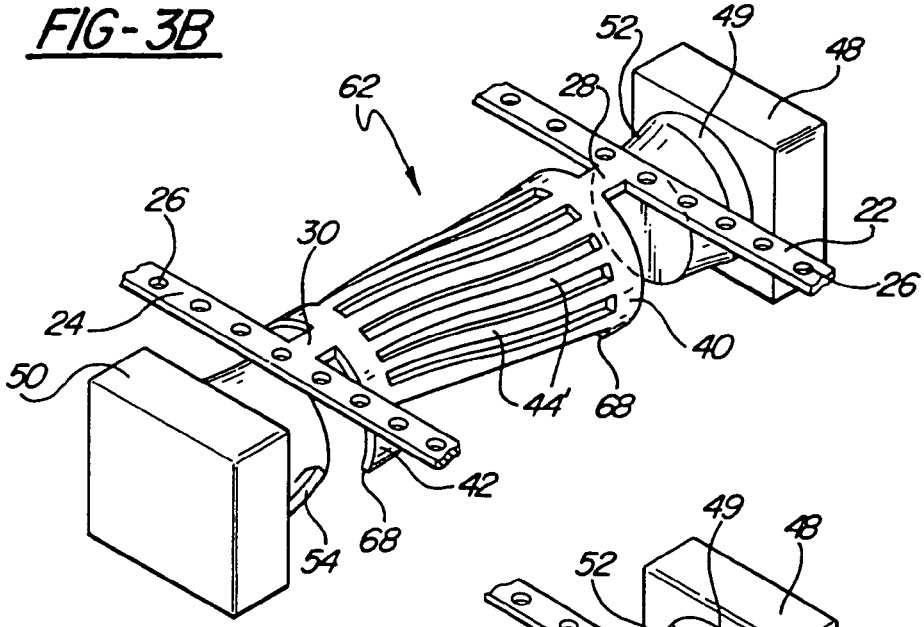
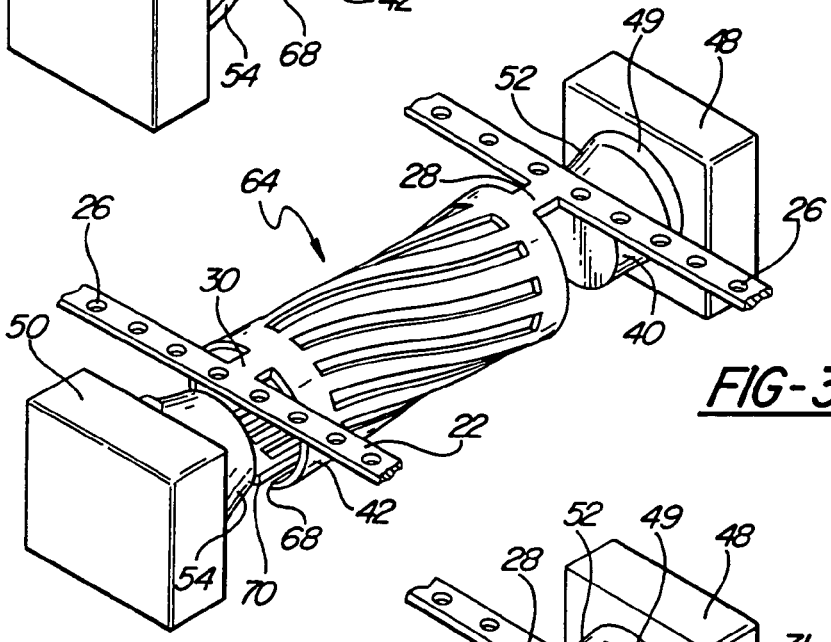
FIG-3C
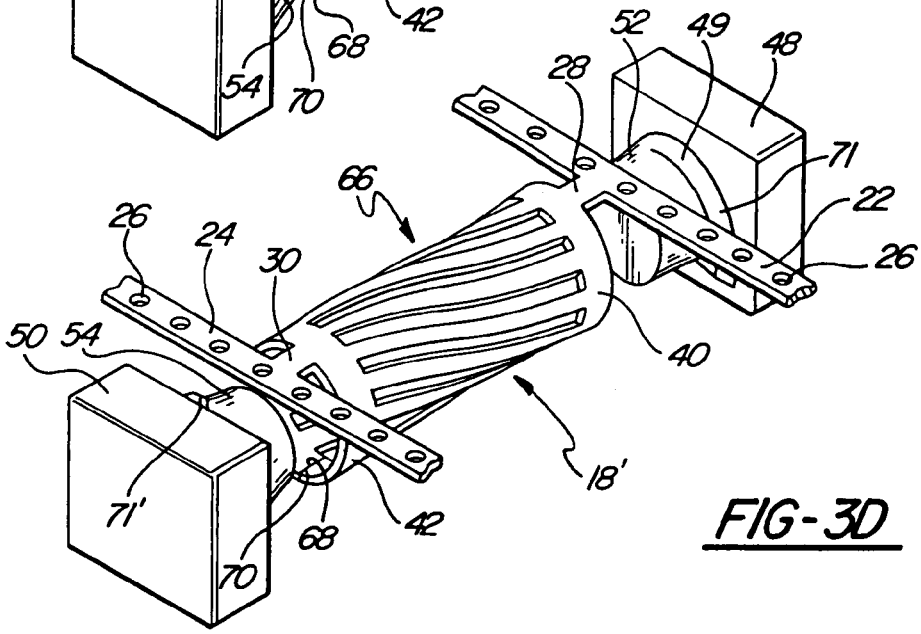
FIG-3D

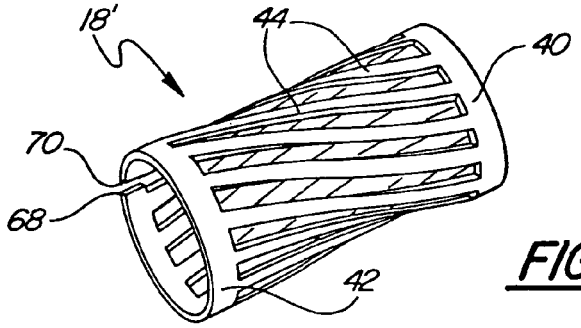
FIG-7
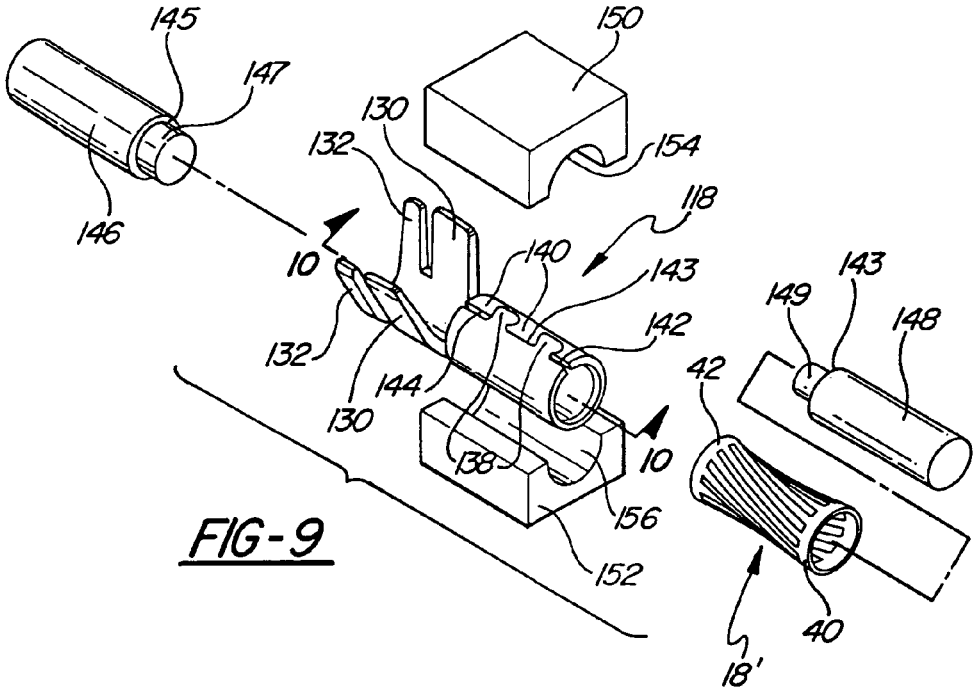
FIG-9
FIG-10
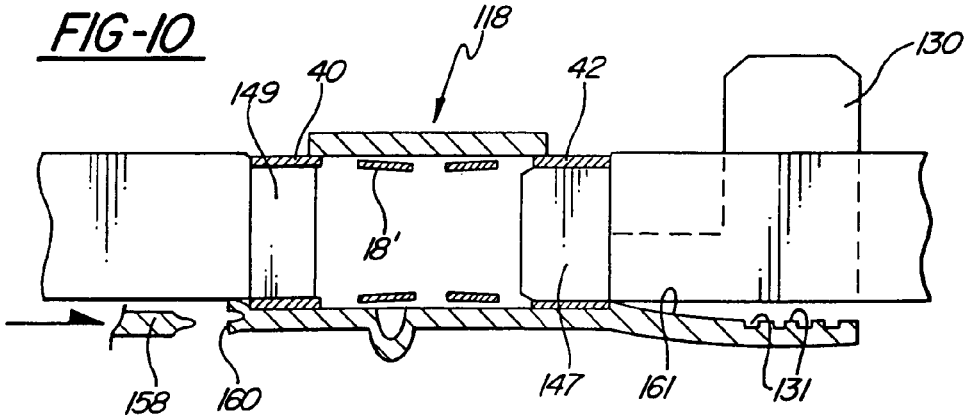

ELECTRICAL TERMINAL SOCKET ASSEMBLY INCLUDING BOTH T SHAPED AND 90° ANGLED AND SEALED CONNECTORS

CROSS REFERENCE TO RELATED APPLICATIONS

This application is a Divisional of application Ser. No. 09/951,012, filed on Sep. 14, 2001 now U.S. Pat. No. 6,875,063, which claims priority to Ser. No. 60/232,698, filed Sep. 15, 2000, and Ser. No. 60/271,776, filed Feb. 27, 2001.

FIELD OF THE INVENTION

The present invention relates generally to sealed power connectors and feed attachments, such including resilient engagement capability. More particularly, the present invention is directed to an electrical terminal socket assembly and method for constructing which incorporates a helically wound and compressible spring cage and an encircling tubular shaped and compressible terminal sleeve for holding the spring cage in place. The present assembly and method for constructing provides a low cost solution for a quick connect assembly and which requires a much greater degree of torque control in assembly as opposed to prior art bolt and nut type cable connections. The present invention further discloses both "T" shaped and 90° sealed connection assemblies, which include angled variations of the terminal socket assembly enclosed within interengaging male and female outer connecting portions, and for better insulating and sealing the electrical connections established by the socket assembly.

BACKGROUND OF THE INVENTION

Electrical connectors of the terminal socket variety are well known in the art, one primary application of which being in the automotive field for establishing connections between heavier sized output cable and components such as generators or alternators. The frictional grip imparted by the connector must be of sufficient strength to maintain firm mechanical and adequate electrical connection, yet must permit relatively easy manual withdrawal or insertion of a prong into the connector socket.

One type of known prior art electrical cable connection is the bolt-nut type electrical cable connection. A significant problem associated with such bolt and nut arrangements arises from the amount of torque which is necessary to assembly the connector and the difficult quality control issues which arise from its large scale use such as over torque, under torque and cross thread.

Generally, it has also been difficult to manufacture spring cage socket terminals, designed from either a single piece of material or assembled from parts, which may include a plurality of individual connector strips or wires. In instances where the terminal is constructed in one piece, several complex machining and forming steps are required. Additionally, construction of a socket terminal starting with individual contact strips requires a tedious assembly process and involving more than four (4) components. As such, manual assembly involving socket terminals is both an intricate and difficult task, as well as a necessary one, and significantly increases a cost of production associated with the connector.

Another example of a radially resilient terminal socket is set forth in U.S. Pat. No. 4,657,335, issued to Koch, and which teaches constructing a barrel terminal socket by forming a sheet metal blank with uniformly spaced, parallel, longitudinal strips integrally connected at their opposite ends to transversely extending webs. The blank is then formed into a cylinder, inserted into a close-fitting cylindrical sleeve and one end of the blank is fixedly secured to the sleeve. The opposite end of the blank is then rotated relative to the sleeve through a predetermined angle and then fixedly secured in its rotated position to the sleeve. Accordingly, Koch teaches a multiple of individual assembly steps and the use of no less than five (5) separate components, which are necessary to complete the construction of the terminal socket.

U.S. Pat. No. 4,734,063, also issued to Koch, discloses additional, methods and techniques for constructing the barrel terminal, including the contactor strip portions being provided as a plurality of individual and spaced apart blanks attached to a carrier strip (46). Each blank is advanced through a number of work stations and assembled utilizing no less than four (4) components, such varied assembly steps including forming the contactor strips into a hollow barrel configuration and fitting the sleeve onto the barrel configured blank.

In summary, the above two prior art patents each utilize at least four (4) or more components in order to construct a power terminal, the net effect of which it so increase the cost, render more complex the design, and slow processing of the parts. It is further found that the provision of many joints, connecting these components together, decreases the effective contact surface for effecting the electrical communication, and has been found to be less reliable and have more potential failure modes.

In sum, it has been determined that it is important to maintain sufficient contact surface and in order to guarantee that an adequate amount of electrical current is carried through the terminal assembly.

SUMMARY OF THE INVENTION

The present invention discloses an electrical terminal socket assembly and method for constructing which incorporates a helically wound and compressible spring cage and an encircling tubular shaped and compressible terminal sleeve for holding the spring cage in place. As previously explained, the present assembly and method for constructing provides a low cost solution for a quick connect assembly and which requires a much greater degree of torque control in assembly, as opposed to prior art bolt and nut type cable connections. The present invention is also an improvement over prior art assembly techniques which require the spring cage element to be formed in place after it is has been inserted into the corresponding sleeve component, particularly in that the present invention provides only two components and a simplified assembly process. It is further contemplated that the assembly part can be manufactured in conjunction with a fast speed progression die.

A spring cage blank has first and second extending edges and a plurality of spaced apart and angled beams extending between the edges. In a preferred variant, a plurality of the spring cage blanks are provided in spaced fashion between first and second carrier strips and which permit the blanks to be transferred in succession into an appropriate die stamping or forming operation. Such stamping or other suitable forming operation typically includes the provision of first and second spaced apart and opposing mandrels, each further including a substantially cylindrical projection with inwardly sloping walls engaging thereupon the associated extending edges of the spring cage.

In one variant, female die patterns are employed in one or more stamping/forming operation to form the spring cage blank in to a substantially cylindrical configuration and in which the angled beams are arranged in a substantially helix pattern. In a still further variant, the stamping dies are succeeded by alternately configured forming dies, the purpose of which being to grasp the opposite extending edges of a substantially formed spring cage and subsequently to torsionally bend the spring cage a specified angular degree in a direction consistent with the angle established by the beams. Depending upon the configuration of the female die surfaces, and/or the application of the torsional bending step, the formed spring cage may further exhibit a substantially "hourglass" shape and which will improve its connector biasing qualities in subsequent use.

A substantially tubular shaped and interiorly hollowed sleeve is provided for receiving the substantially cylindrically/hourglass shaped spring cage in axially inserting and fixedly and pressure retaining fashion. The spring cage is typically dimensioned to slidably engage within the axial interior of the tubular sleeve without an excessive amount of effort. The sleeve is in turn typically slitted or otherwise configured so that opposing edges are separated by a specified gap and are capable of being compressingly engaged together. In a preferred variant, meshing keyed portions are defined along the slitted and gapped surface and so that, upon inserting assembly of the formed spring cage, the exterior surface of the sleeve is compressingly engaged (such as again through the employed of stamping dies or other suitable manufacturing operation) and in order to create a desired interference fit between the spring cage and the interior of the sleeve.

The interference fit created between the spring cage and sleeve provides the primary retaining feature of the terminal socket assembly. Additionally however, a lance is associated with a transition area of the tubular sleeve and functions as a cage forward stop. A front dish-like feature is installed after the cage is located in proper position. The front dish-like feature functions as a forward stop and further assists in retaining the cage inside the sleeve. It is again understood that the lance and dish-like feature are supplemental features which assist in retaining the cage inside the tubular sleeve.

In order to complete the electrical connection, an extending end of a male pin is secured within the interiorly hollowed sleeve and assembled spring cage. The sleeve, in any of a number of alternate variants, further includes actuable gripping portions for fixedly engaging against and securing an extending end of a cable. The gripping portions may further be configured so that the cable extends in an angular (typically 90°) relationship relative to the male pin secured to the sleeve and spring cage assembly.

Assembly configurations of the quick connect socket assembly further disclose both "T" shaped and 90° sealed assemblies. Such housing assemblies include interengaging male and female outer connecting portions and associated seals and retainers, and for electrically and environmentally sealing and insulating the socket assembly and extending cables.

A method for assembling a terminal socket assembly is also disclosed, substantially according to the afore-described assembly, and includes the steps of providing at least one spring cage blank with first and second extending edges and a plurality of spaced apart and angled beams extending between the extending edges and forming the spring cage blank into a substantially cylindrically shaped configuration and in which the angled beams are arranged in a substantially helix pattern. Additional steps include providing a substantially tubular shaped and interiorly hollowed sleeve, insertably assembling the formed spring cage into an open end of the sleeve, and compressingly actuating the sleeve in biasing fashion about the spring cage so that it can biasingly engage an extending end of the male pin, concurrent with sleeve gripping an extending end of the cable at a further location to electrically communicate the male pin with the cable.

BRIEF DESCRIPTION OF THE DRAWINGS

FIG. 3B illustrates a further operating station employing a further compression forming operation to a semi-cylindrically configured spring cage;

FIG. 3C illustrates a yet further operating station in which a yet further compression forming operation is performed to a more substantially and cylindrically configured spring cage;

FIG. 3D illustrates a final operating station in which a further compression forming operation is performed to complete the cylindrical spring cage shaping of the blank and in which opposite joining ends of first and second extending ends are over-flexed in opposite directions in order to establish an on-plane configuration during subsequent material spring-back;

FIG. 7 illustrates a substantially formed spring-cage and which exhibits both a helical winding pattern to the spaced beams as well as a substantially hourglass configuration;

FIG. 9 is an exploded view of an assembly operation for inserting and fixing a formed spring cage within a terminal sleeve according to the present invention;

FIG. 10 is a cutaway view taken along line 10—10 of FIG. 9, following insertion of the spring cage into the sleeve, and illustrating the biasing nature of the compressible sleeve applied to the cage in order to create an interference fit therebetween;

DETAILED DESCRIPTION OF PREFERRED EMBODIMENTS

Figure 8B:
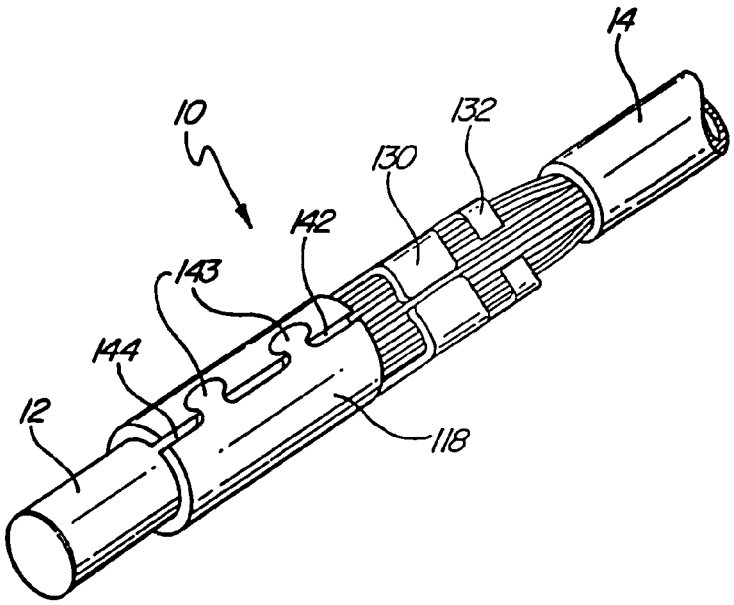
FIG. 8B is an illustration, similar to that illustrating in FIG. 8, and in which the engaging end of male pin is illustrated mated to the sleeve terminal according to the present invention.
Figure 8:
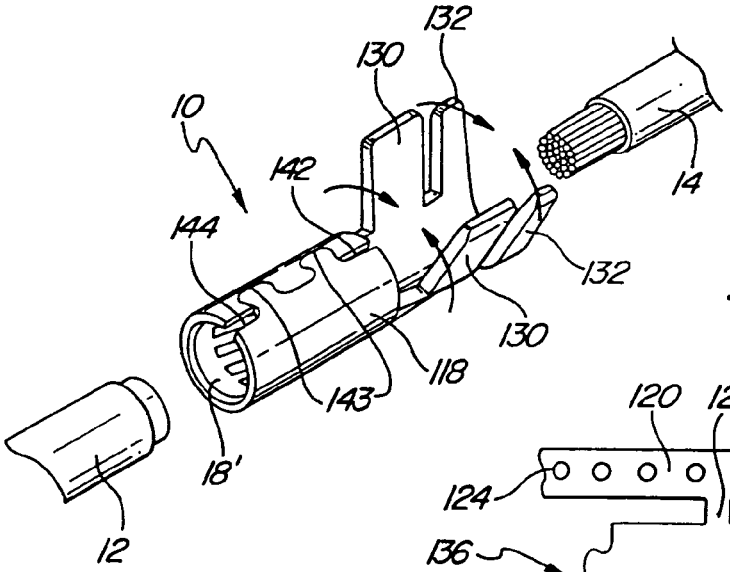
FIG. 8 is an exploded illustration of a substantially assembled and tubular/compressible terminal sleeve, housing a formed and inserted spring-cage for mating with a male pin, and within an opposite end of which is engaged an existing vehicle cable according to the present invention.

Referring to the appended drawing illustrations, and in particular to FIGS. 8 and 8B, a terminal socket assembly is illustrated at 10 according to one preferred variant and in order to interconnect electrically powered vehicular components (not shown) via an associated male pin 12 and a cable 14, such connecting inputs as pins and cables typically corresponding to an input or output of selected vehicular components. As previously described, the terminal assembly and method for constructing provides a low cost solution for a quick connect assembly and which requires a much greater degree of torque control in assembly, as opposed to prior art bolt and nut type cable connections. The present invention is also an improvement over prior art assembly techniques which require the spring cage element to be formed in place after it is has been inserted into the corresponding sleeve component.

Figure 1:
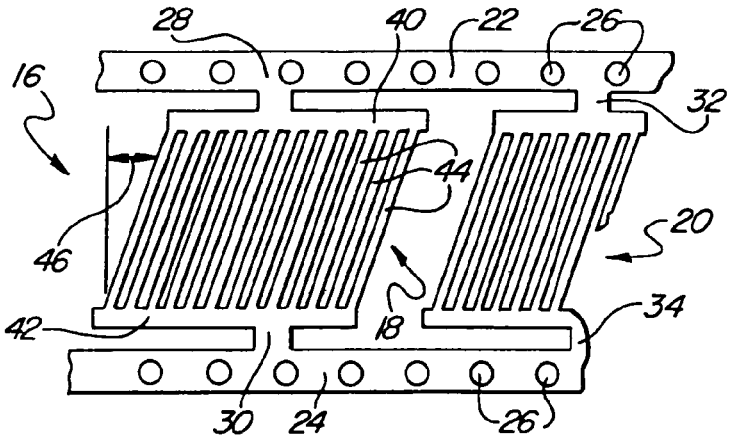
FIG. 1 is an illustration of spring cages, in initial flat blank form, exhibiting a plurality of angled and spaced apart beams, and which are supported between upper and lower carrying strips according to the preferred embodiment of the present invention.

Referring again to FIG. 1, a spring cage blank assembly is generally illustrated at 16 and, in the preferred embodiment, includes individual and spaced apart spring blanks 18, 20, et. seq., which are supported upon a pair of first 22 and second 24 carrier strips. The carrier strips 22 and 24 each in turn include spaced apart and axially defined apertures 26 (defined through both top 22 and bottom 24 strips) as well as establishing connecting portions with the blanks (see connecting portions 28 and 30 for spring cage blank 18 and connecting portions 32 and 34 for blank 20).

The apertures 26 defined in the upper and lower carrier strips permit the assembly 16 to be transported upon a suitable conveying apparatus (not shown), such as which operates in conjunction with a suitable stamping or forming operation (as will be hereinafter described). The connecting portions 32, 34 and 36, 38 further function to provide first and second supporting locations for the subsequent shaping and forming operations to be performed on each of the spring cage blanks 18, 20, et. seq.

The spring cage blanks 18, 20, et. seq., are each constructed of a spring copper material, having a specified thickness and configuration. In particular, and referencing the blank 18, the spring cage includes a first (or upper) extending edge 40 (secured to the first carrier strip 22 via upper connecting portions 28 and 32) and a second opposite and spaced apart (lower) extending edge 42 (secured to the second carrier strip 24 via lower connecting portion 30 and 34).

A plurality of spaced apart and angled beams 44 extend between the extending edges 40 and 42 and, in a preferred embodiment, are provided at an angle ranging typically from between 4° to 25° relative to a longitudinal direction (see at 46) and in order to provide the plan view appearance of the spring clip 18 with an overall parallelogram shape. It is however understood that the spaced apart beams 44 may be provided at any suitable angle relative to the upper 40 and lower 42 extending edges, the result of which typically having some affect on contact force between male pin and terminal socket assembly.

Figure 2A:
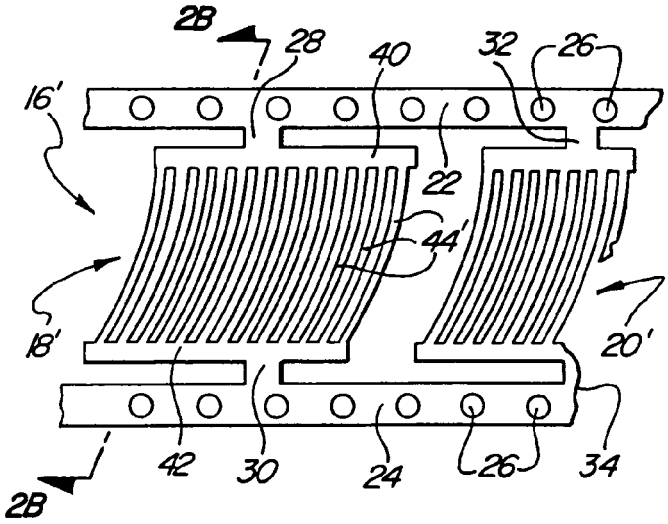
FIG. 2A is an illustration of the spring cage blank after a first forming operation, and in which the angled and spaced apart beams extend according to a given arcuate and pre-calculated curvature.

General illustration 16' of the spring blank assembly in FIG. 2A illustrates, in particular, a selected spring cage blank 18' having undergone a first processing or forming operation and in which an arcuate curvature is formed into each of the spaced apart and angle beams (see at 44'). The spring cage blanks 16' and 20' are otherwise substantially identical to that also illustrated at 16 in FIG. 1 and it is understood that any suitable type of bending, stamping or initial forming operation may be provided in order to create the necessary arcuate curvature in the spaced apart beams 44'. It is also envisioned that the spring cage to be formed can be created from a blank as originally shown in FIG. 1, without the additional operation performed by FIG. 2A, and within the scope of the invention.

Figure 2B:
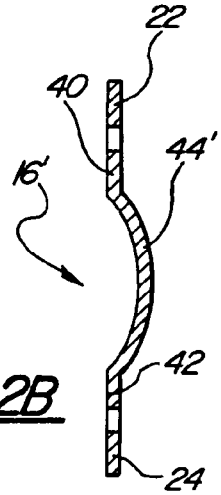
FIG. 2B is a cutaway view taken along line 2—2 of FIG. 2A and which illustrates a side view configuration of the selected spring beam illustrated in FIG. 2A, prior to subsequent forming operations performed according to the present invention.

Referring further to FIG. 2B, the selected spring clip blank 16' in FIG. 2A is illustrated in side cutaway profile and exhibiting a cross sectional arcuate profile designed into the extending and angled beams 44'. In a preferred variant, a pre-calculated radius is designed into the cross sectional geometry of the beams 44' so that, during subsequent forming operations, the spring clip acquires the desired substantially hourglass shape (see at 18' in FIG. 7) for subsequent application within the socket assembly 10. As is also illustrated by formed spring clip 18', an "hourglass" shape may be created and reference is made to the following description.

Referring back to FIGS. 1 and 2A, it is also understood that the second spring cage blank 20 and 20' (as well as each succeeding blank located along the carrier strips 22 and 24) is constructed in substantially identical fashion to that more completely illustrated and described at 18. Accordingly, repetitive enumeration and description of the corresponding elements in second blank 20 is foregone and for purposes of ease of illustration.

Referring to FIGS. 3A–3D collectively, a forming operation is illustrated according to a first variant for shaping the spring cage blanks 18', 20', et. seq., into the substantially cylindrical and, in specified instances, hourglass configuration of the spring cage (see again at 18' in FIG. 7). Specifically, the forming operation according to this variant employs a pair of inwardly and opposingly facing mandrels 48 and 50. One or both of the mandrels 48 and 50 are capable of being actuated inwardly and outwardly and each further includes a substantially cylindrical projection, see at 52 for mandrel 48, as well as at 54 for mandrel 50. The cylindrical projections 52 and 54 are likewise arranged in opposing fashion and along a common axis so that, during bending/shaping operations, they provide a support for the associating beams 44'.

One or both of the mandrels 48 and 50 each includes a short cylinder, see at 49 for mandrel 48, as well as a same short cylinder for mandrel 50 (not showing in illustrations). Both short cylinders, 52 and one at mandrel 50 (not shown) are likewise arranged in opposing fashion and along a common axis so that, during bending/shaping operations, they provide a support for the associating edges 40 and 42 of the spring cage blank 18. As best illustrated, the projections 52 and 54 each further include inwardly/downwardly sloping and annular extending walls and which assist in establishing the desired end configuration of the spring cage.

Figure 3A:
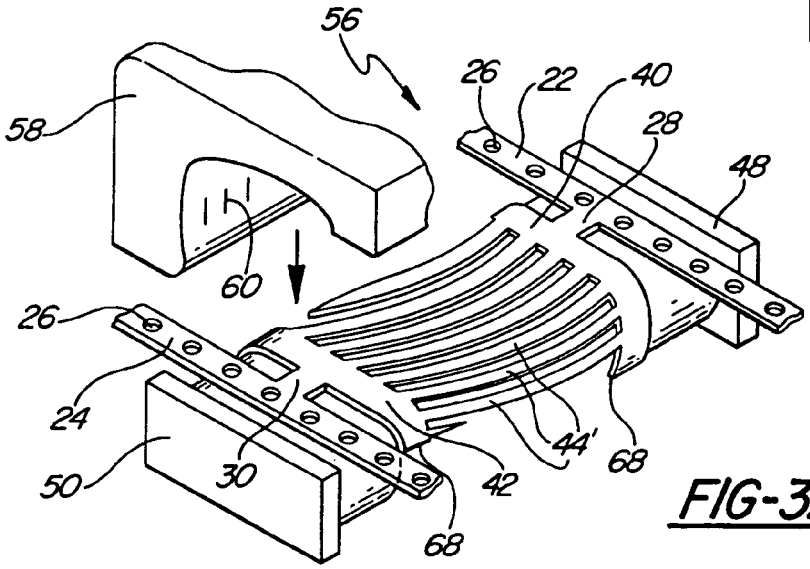
FIG. 3A illustrates an operating station employed in a spring cage bending operation according to a preferred variant and in which an initial forming operation is performed upon the previously arcuately formed beams of the spring cage blank of FIG. 2A and by compression forming a selected spring cage blank about a pair of opposing and configured mandrels secured, respectively, to first and second actuating cylinders.

Referring to FIG. 3A, an initial operating station, illustrated generally at 56, and in which female die (illustrated partially 58) is employed for providing an initial stamping configuration to the curved beams 18'. As previously described, the provision of the spring clip blanks 18', 20' et. seq., in plurality fashion and supported upon the carrier strips 22 and 24 permits a successive and relatively high speed operation to be performed in which the spring cages are quickly and successively form shaped into the desired configuration 18'.

The female die 58 includes a specified inwardly radial configuration 60 such that, in an initial forming operation, a first semi-shaping configuration (again FIG. 3A) is imparted to the spring cage 18'. It is also envisioned that a pair of opposing female dies can be provided on opposite facing (upper and lower) sides of the mandrel and spring cage assembly (see also variants of FIGS. 4 and 5), with the exception of having a different inwardly radial configuration (see again at 60).

For each succeeding operating station, see at 62 for FIG. 3B, at 64 for FIG. 3C and, finally, at 66 for FIG. 3D, progressively configured female dies (either singularly or in pairs) may be provided (although not shown) for successively shaping the spring cage until it achieves its desired configuration, the hour glass shape, 18' (FIG. 3D) which substantially replicates the illustration of FIG. 7.

In FIG. 3C, corners 68 and 70 of the joint end 42 are offset in axial direction and in which the corner 70 is forward and the corner 68 is backward, and further such that end 42 is now arranged in helix fashion, as is joint end 40. Ideally, the corners 68 and 70 must also be at same plan and which is caused forces exerted by the angular beams 44' and material mechanical resistance. The use of the mandrels at each forming station minimizes the offset of the corners 68 and 70 at joint end 42 as well as at other joint end 40.

In a final of the successive forming operations, and referring specifically to FIG. 3D, a turning-slide shape 71 is incorporated into the right side of mandrel 48. Additionally, a mirrored turning-slide shape (only partially illustrated at 71') is arranged at the left side of mandrel 50. Opposite joining ends of the right half (or less than half) at first extending edge 40 and the left half (or less than half) at second extending edge 42 are over-flexed in opposite axial directions by the shaping forces exerted by the two turning-slide shapes 71 and 71' when the mandrels 48 and 50 move inward.

The purpose of the over-flexing is in order to establish an on-plane configuration (meaning corners 68 and 70 are on same plan at end 42, same fashion at other end 40) during subsequent material spring-back and which is associated with the tensioned copper spring cage construction. The distance of over-flexing is pre-calculated according to material properties.

It is also envisioned to be within the scope of the invention that a plurality of individual pairs of actuable mandrels (48 and 50) be employed (such as for each succeeding operating station in FIGS. 3A, 3B, 3C and 3D). Alternatively, a standard pair of mandrels and cylindrically projecting forming surfaces may be provided and, instead, alternating and/or progressively configured female dies may be transferred in succeeding fashion to provide the necessary forming/shaping operations of the spring cage 18.

Figure 4:
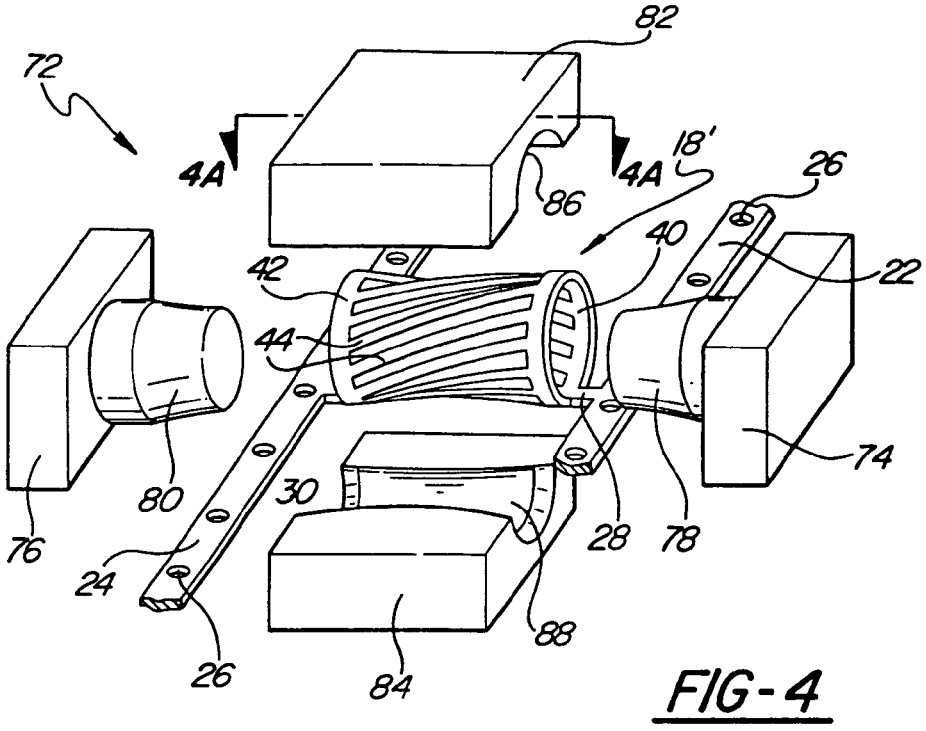
FIG. 4 illustrates a spring cage bending operation according to a second preferred variant of the present invention and in which a single forming stage again includes a pair of opposing and cylinder actuated mandrels, combined with first and second opposing and actuable forming dies defining collectively a substantially hourglass-shape configuration to be imparted to the spring cage.

Referring now to FIG. 4, a further variant is illustrated at 72 of a single stage forming operation of the associated spring cage 18' and which again includes such elements as first and second mandrels 74 and 76, as well as associated and curving cylindrical projections 78 and 80. The projections 78 and 80 are configured to match the inner annular configuration of the corresponding ends of the spring cage during forming and provide a support shoulder or surface to each of the corresponding edges 40 and 42 of the spring cage blank 18, 20, et. seq., during formation into its ultimate hourglass shape 18' inside of the formed cage. As previously described, the mandrels 74 and 76 and associated projections are mounted in axial and inwardly/outwardly actuating fashion and in order to work in conjunction with an assembly line process by which the elongated carrier strips 22 and 24 transfer each of a succeeding plurality of the spring cage blanks to the operation station 72.

Figure 4A:
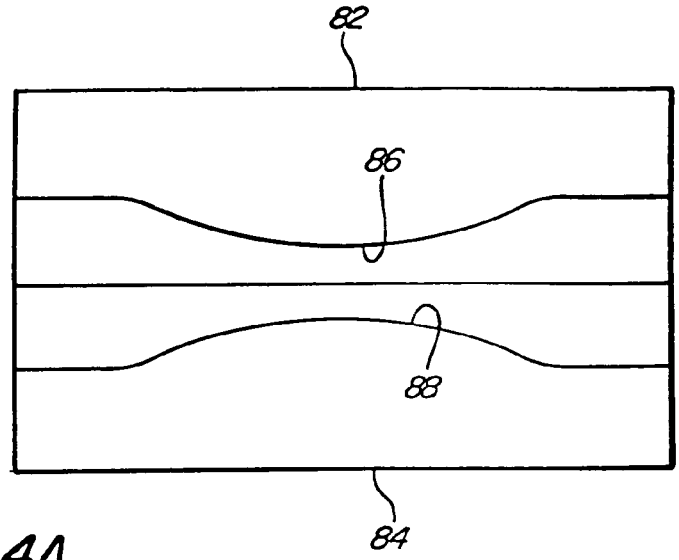
FIG. 4A is a cutaway view taken along line 4A—4A in FIG. 4 and illustrating, in side cutaway profile, the arcuate hourglass configuration established between mating female die surfaces and which also completes the progression set forth in FIGS. 2A to 4A to illustrate the manner in which the contact beams of the cage are formed and constructed in a substantially hour-glass configuration.

A pair of opposing and inwardly actuating dies 82 and 84 are provided and in order to define the substantially cylindrically-configured spring cage, in a single forming/stamping operation, with an "hourglass" shaping to the outside surfaces of the substantially formed cage 18'. This shaping is assisted by female configured surfaces 86 and 88 (corresponding to dies 82 and 84) and which in particular define the negative impression of the hourglass shape (see also FIG. 4A cutaway).

Figure 5:
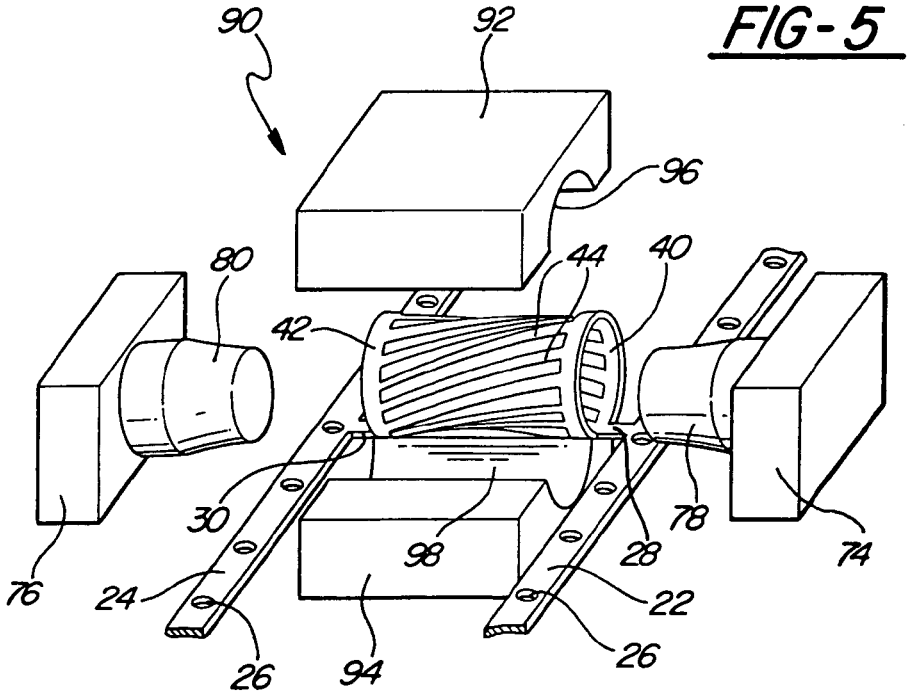
FIG. 5 illustrates a spring cage bending operation according to a third preferred variant of the present invention, substantially as presented in the variant of FIG. 4, and in which, in a first forming operation, the mating female die surfaces are configured to provide a cylindrically formed spring cage with a larger and substantially constant radius.

Referring further to FIG. 5, an alternate forming operation is illustrated at 90 and which is substantially similar to that previously described at 72 in FIG. 4. The variant 90 of FIG. 5 does differ in the manner in which the opposing and mating dies 92 and 94, and in particular their corresponding and opposing negative impression surfaces 96 and 98, are configured. The dies 92 and 94 of FIG. 5 provide a somewhat enlarged and consistent radial profile (see as opposed to substantially hourglass shaped dies 82 and 84 in FIG. 4) and in order that the configured spring cage blank 18' acquires the ultimately cylindrical shape without the additional "hourglass" configuration at this stage. The projections 78 and 80 of mandrels 74 and 76, respectively, can additionally be either taper shaped as shown or cylindrical shape.

Figure 6:
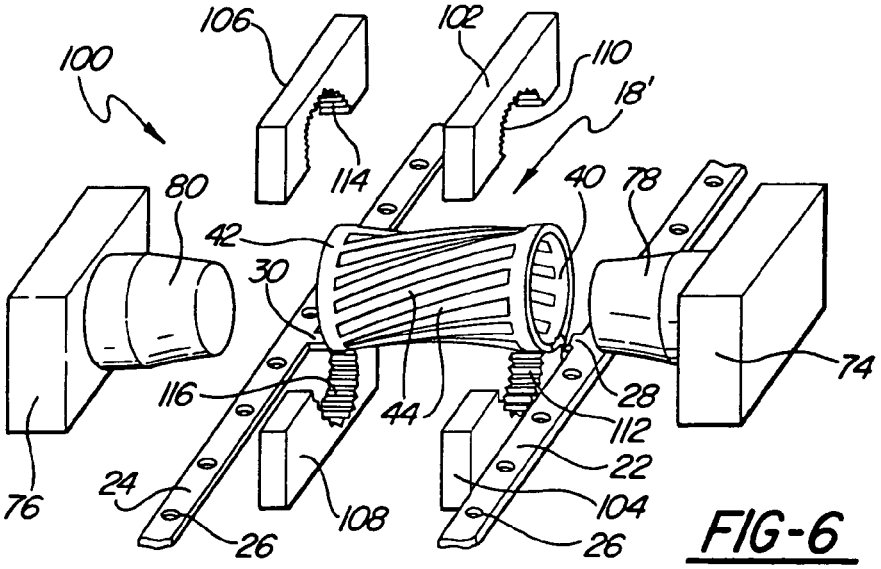
FIG. 6 illustrates a succeeding forming operation, to any of the afore-described preferred variants, and which provides an operating station including first and second pairs of opposingly actuable forming dies each of which including meshing teeth which, in combination with the cylinder actuable mandrels, grasp the end connecting belts of the associated and cylindrically formed spring cage to impart a further twisting and torsional profile.

Referring now to FIG. 6, a further forming operation is illustrated at 100, typically employed subsequent to the initial stamping operation of FIG. 5, and which completes the configuration of the previously and substantially cylindrically shaped spring cage blank 18' with a desired hourglass configuration. As with the description of FIG. 5, the configuration of the spring cage blank 18, mandrels 74 and 76 and associated shoulder projections 78 and 80 in FIG. 6 are again repeated and may again be part of a same operating station as utilized with the mating dies 92 an 94. The additional forming/operating station 100 of FIG. 6 does also include the provision of first (102 and 104) and second (106 and 108) pairs of opposing and inwardly actuable forming dies and it is understood that these are transferred into contact with the cylindrically formed spring cage following the stamping procedure of FIG. 5.

The first pair of forming dies 102 and 104 encircle and are inwardly actuable abut in proximity to the first extending end or edge 40 of the spring cage, the second pair of forming dies 106 and 108 likewise encircle and abutting the second extending end 42. Each of the forming dies 102, 104, 106 and 108 further includes a plurality of teeth arranged in corresponding and semi-circular patterns for securely gripping the edges 40 and 42 of the substantially cylindrically formed spring cage following operation in FIG. 5 and in proximity to the spaced apart beams 44. Reference is made specifically to semi-circular/radial teeth patterns 110, 112, 114 and 116 and which correspond, respectively, with each of the succeeding forming dies 102, 104, 106 and 108.

Upon both pairs 110 & 112 and 114 & 116 of the forming dies being inwardly actuated in gripping fashion about the corresponding ends 40 and 42 of the sleeve, either or both pairs 102 and 104 are rotated a selected angle in a direction consistent with the angle 46 established by the beams 44'. In a preferred variant, and upon rotation of the selected cage end (such as at 40), the associated connection 28 is cut off (see as best shown in FIG. 6), after which the operation performed in FIG. 5 is commenced and the end 40 is thus free to be rotated.

In the preferred variant, the first pair 114 & 116 of the forming/gripping dies are rotated (the second pair 110 & 112 of forming/gripping dies remaining fixed) in an angular direction ranging from between 12 to 18 degrees (an ideal configuration being a 15° imparted angle) relative to the second pair of forming dies. Following the torsional/twisting operation, the completed spring cage 18' is sectioned from the carrier 24 (via the connecting web portions 30). In this manner, the substantially hourglass shaping is imparted to the previously cylindrically formed configuration of the spring cage at the operation illustrated in FIG. 5 and in order to provide enhanced gripping and biasing characteristics within the socket assembly 10 as will be shortly described in more detail.

Figure 8A:
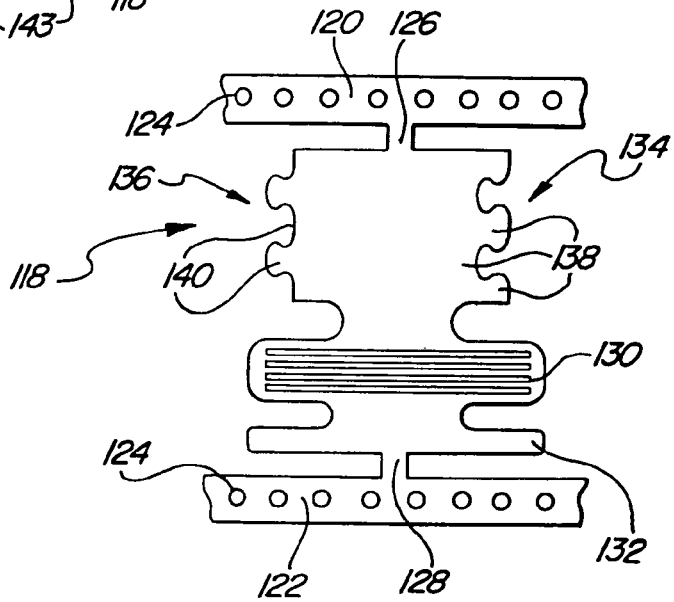
FIG. 8A is an illustration of the terminal sleeve provided in an initially blank-shape prior to subsequent forming operations performed according to the present invention.

Referring again to FIGS. 8 and 8B, a substantially tubular shaped and interiorly hollowed sleeve 118 is illustrated in use with the present invention and which forms a component of the assembleable and terminal socket assembly 10. The sleeve 118 may, similarly to the assembled spring cage 18', be formed of a tensioned copper material and, referring further to FIG. 8A, it is contemplated that the sleeve 118 may also be initially provided as a blank shape configuration, supported between carrier strips 120 and 122 transferable by apertures 124 formed there along their axial lengths, and connected to the strips 120 and 122 by webbed/connecting portions 126 and 128. As with the illustration FIG. 1 of the spring cage blanks 18, 20, et. seq., a plurality of individual and spaced apart tubular sleeves 118 may be provided along the carrier strips 120 and 122 and which are subject to an appropriate stamping/die forming operation for assembling into the desired shape again referenced in FIGS. 8 and 8B.

Referring again to FIGS. 8, 8A and 8B in particular, the tubular sleeve 118 of the illustrated and preferred variant includes gripping portions in the form of spaced apart pairs 130 and 132 of tabs which, upon inserting the appropriate end of the existing vehicle cable 14, are bent or actuated in the manner indicated to fixedly engage and electrically communicate the cable 14. As is also illustrated from the blank layout of FIG. 8A and the cutaway of FIG. 10, an inner base surface of the sleeve 118 corresponding to the pair 130 of tabs includes a plurality of lateral extending and spaced apart grooves 131, the purpose for which being to provide additional gripping capacity to the coils extending from the cable 14 once the tabs 130 and 132 have been actuated (see arrows in FIG. 8) and to the fixing location of FIG. 8B. The male pin 12 may also include, without any limitation, a configured end with a lead chamfer, as illustrated, which is ideally suited for exerting a correct pressure/friction mating with the biasing interior of the assembled spring cage and sleeve.

The tubular sleeve 118 further includes a substantially axially extending and slitted incision which defines first 134 and a second 136 opposing and predetermined spaced apart edges. The edges 134 and 136 are further defined, in one preferred variant, by an alternating keyed pattern (see at 138 for edge 134 and at 140 for edge 136). Keyed alternating projecting and recessing keyed portions defined by these patterns meshingly engage one another, upon assembly of the sleeve 118 and in the manner shown in FIG. 8, and so that a pretermined and incremental spacing, see also at 142, 143 and 144, exists between the mating and opposing edges 134 and 136 and, to a lesser extent, around and along the alternating keyed projections and recesses. The incremental spacing is created by not fully closing the key stone edges 138 and 140, such that edges 134 and 136 are maintained at a calculated and slightly spaced apart position.

An aspect of the terminal socket assembly 10 is the ability to pressure and frictionally engage the formed spring cage 18' within the sleeve 118, upon completed assembly, and this is performed by initially inserting the cage 18' into an axial and open end of the sleeve 118. Referring to FIG. 9, a single pin 148 (or pair of opposite pins 146 and 148 arranged in opposite arraying fashion) may be employed to axially insert the cage 18' into the tubular sleeve 118 through the force (linear or opposing) exerted by shoulders 143 and 145 which define narrowed projecting portions 145 and 149 of the pins 146 and 148, respectively. Typically, the exterior diameter of the cage 18' is an incremental amount lesser than a corresponding inner diameter of the tubular sleeve 118 and in order to permit the spring cage 18' to be easily inserted during assembly and because the incremental spacing is created by not fully closing key stone edges 138 and 149 extending or recessed into the associated edges 134 and 136.

The leading portions 147 and 149 in the tool pins 146 and 148, respectively, are engaged inside with cage ends 42 and 40 in FIG. 10. In a subsequent forming operation, a pair of mating dies 150 and 152 (having corresponding and opposing mating female surfaces 154 and 156 according to specified radii) compressingly engage and inwardly actuate the sleeve 118 about the installed spring cage 18'. In this fashion, the inner diameter of the sleeve is decreaded (by virtue of closing the spacing indicated at 142, 143 and 144), thereby frictionally and permanently engaging the spring cage 18' within the sleeve 118.

The outer diameters of oppositely inserted leads (see at 147 and 149 in FIG. 10) are dimensioned to equal the final diameter of the finished sleeve assembly. During insertion forming (crushing), the sleeve and closing the space 142, 143 and 144, the leads 147 and 149 help to avoid cage ends 40 and 42 clapping and also to hold the specified finish diameter. The dimensions of the perimeters of cage ends 40 and 42 are calculated such that seams on each end of 40 and 42 are in tight contact (for example, reference corners 68 and 70 arranged in tight contact in FIG. 3C). In this fashion, significant amount of pressure between cage ends (40 and 42) and the sleeve is built during die crushing the sleeve.

Referring again to FIG. 10, a pointed tool 158 may be axially displaced to "flare out" one or more annular end location 160*s* of the tubular sleeve 118 and in order to provide additional (typically secondary) retaining force to the previously assembly and compressed terminal socket assembly. A lance 161 may also be defined upon the inside surface, near the mid to rear end of the sleeve (proximate the gripping portions 130) and provides an additional type of secondary holding force by limiting the forward movement of the cage 18' once it has been inserted into the sleeve 118.

Figure 14:
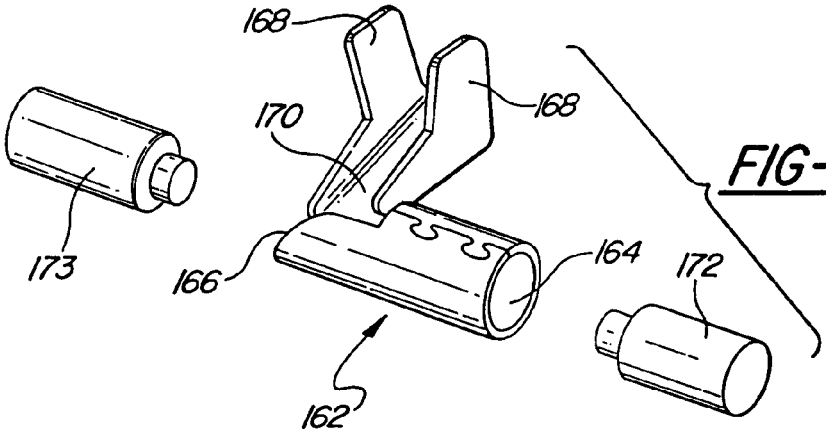
FIG. 14 is an exploded view of a 90 degree variant of a terminal sleeve according to the present invention.

Referring now to FIG. 14, a further variant 162 of a tubular sleeve is illustrated and which includes first 164 and second 166 open ends. A pair of gripping portions 168 define a portion of the sleeve 162 and extend in substantially angular (typically 90° fashion) relative to the axial direction of the inserting sleeve. Inserting pins 172 and 173 may again be utilized in linearly arranged and opposingly engageable fashion to assemble the spring cage (not shown) into the sleeve 162, typically through associated first open and inserting end 164 and in similar fashion as to that previously described in FIG. 9 and FIG. 10. It is also contemplated that all assembly processes, blanking and forming sleeve 118 are built into same progression die.

Figure 11:
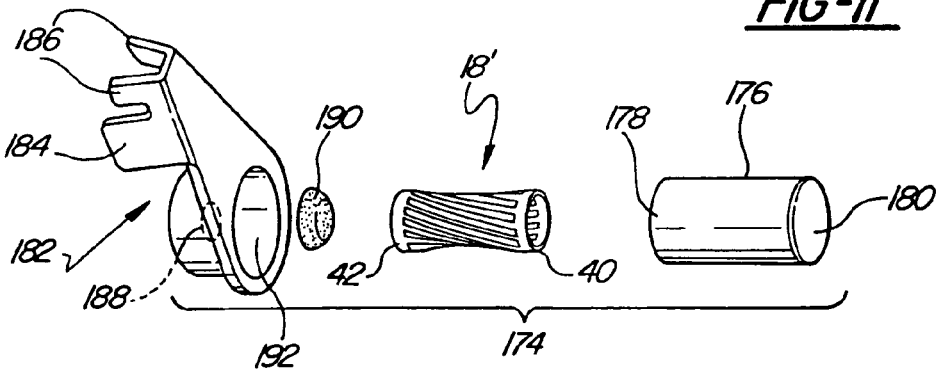
FIG. 11 is a first exploded view of a sealed terminal arrangement according to the present invention and which incorporates an eyelet terminal and associated O-ring.
Figure 12:
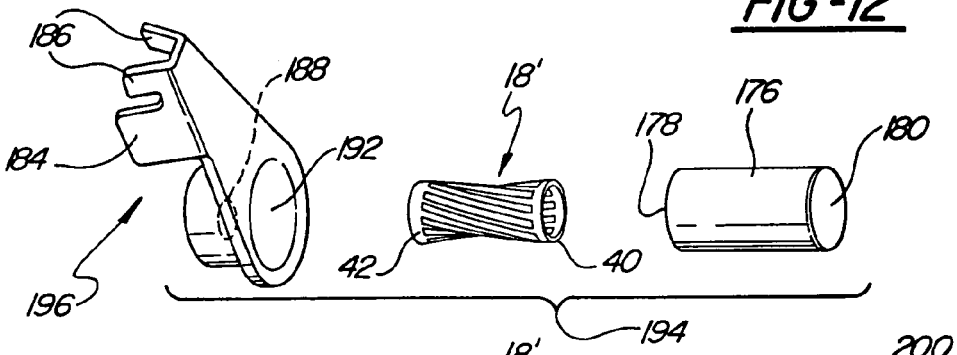
FIG. 12 is a second exploded view of an unsealed terminal arrangement similar to that illustrated in FIG. 11 and, as with both FIGS. 11 and 12, an outer diameter of the spring cage being substantially equal to or slightly smaller than a corresponding inside diameter of the tube which is compressible about the inserted spring cage.
Figure 13:
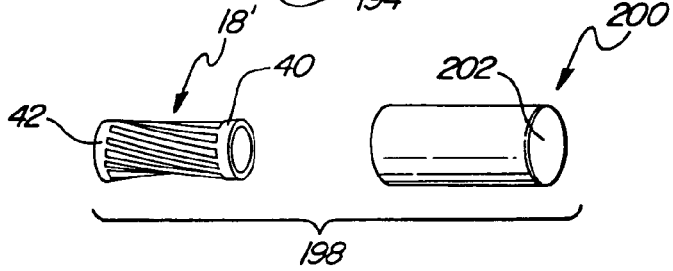
FIG. 13 is an exploded view of an assembly operation according to a further preferred variant of the invention and in which an outer diameter of the spring cage is substantially equal to or slightly smaller than an inside diameter of a modified terminal sleeve, which is compressible about the inserted spring cage.

Referring now to FIGS. 11, 12, and 13, in succession, a variety of assembly variants are illustrated according to additional aspects of the present invention. Referring first to the illustration 174 of FIG. 11, a variation of the sleeve is illustrated at 176 and which is in the form of a tube or bottle with a first end 178 and a second end 180. The second end 180 is considered a bottom of the tube or bottle shape. The opposite edges 40 and 42 of the configured spring cage 18' are dimensioned so that the first edge 40 establishes a smaller diameter than a corresponding inner diameter of the sleeve 176, whereas the second edge 42 establishes a slightly larger diameter. The first edge 40 with the smaller diameter is inserted first into the sleeve 176, following which the opposite edge 42 exhibiting the larger diameter is successively inserted in pressure-fitting fashion.

An eyelet terminal 182 is provided and which includes angular (again preferably 90° extending) gripping portions 184 and 186. An aperture 188 is typically formed through a base of the eyelet terminal 182 and an O-ring 190 is provided which, upon pre-assembly of the spring cage 18' into the sleeve 176, is sandwiched between an inner configured surface 192 of the eyelet terminal 182 and the corresponding first end 178. The eyelet terminal 182 is then friction fitted into tube 176. Upon assembly, the eyelet terminal 182 defines an overall component of the socket assembly and provides a sealed terminal.

Referring to FIG. 12, a subsequent variant is illustrated at 194, largely repeating that previously identified in FIG. 11, and in which an unsealed variant of the terminal is established by deleting the O-ring 190. Otherwise, the spring cage 18' is assembled into the tube variant 176 of the sleeve in similar fashion and so that the gripping portions 184 and 186 extend in the desired angular relationship and so that they can grasp the associated extending end of a cable to be electrically communicated with the terminal socket assembly.

Referring to FIG. 13, a yet further variant 198 of a terminal socket assembly is illustrated and which includes an alternate configuration 200 of a tubular shaped member, which in turn includes an internal receiving sleeve portion 202 (for axially receiving the configured spring cage). The spring cage 18' is further dimensioned so that it exerts the slightest of an interference fit with the interior of the sleeve portion 202 upon inserting the cage 18'. Application of a subsequent compressing force creates the necessary resistance fit of the cage within the tubular sleeve. The illustration 198 additionally illustrates that the terminal socket assembly can be configured in either straight and angled applications and the manner in which the cage 18' is inserted into the sleeve member 200 can again be drawn from any existing variant known in the art.

Figure 16:
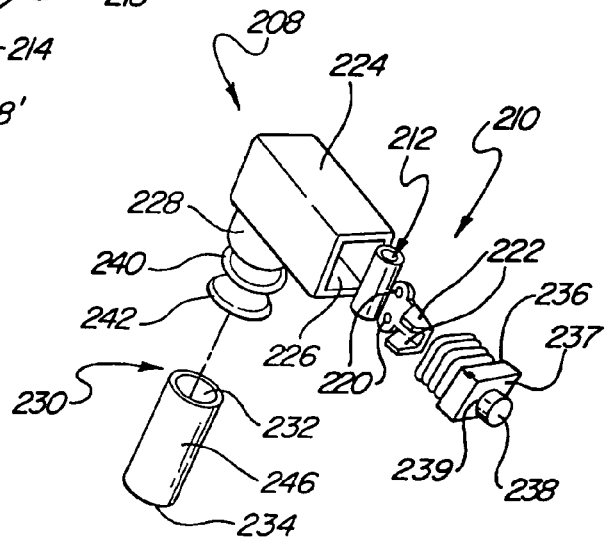
FIG. 16 is an exploded view of a "T" shaped sealed connector incorporating the button-type terminal illustrated in FIG. 15.
Figure 17:
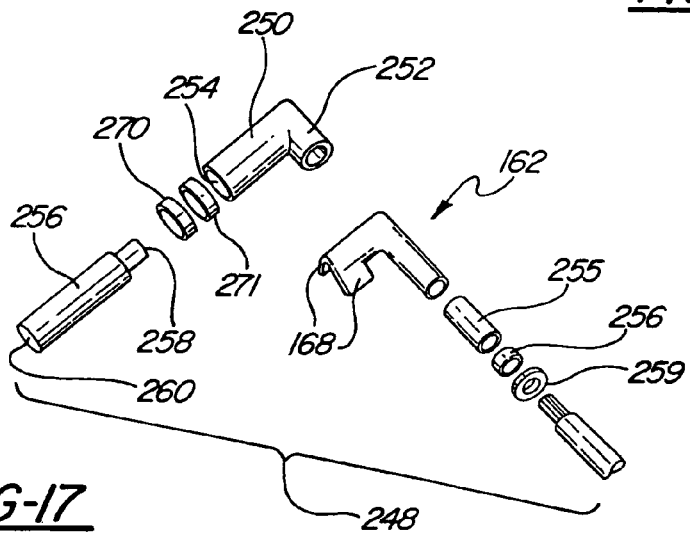
FIG. 17 is an exploded view of a 90° sealed connector according to a further assembled variant of the present invention.

Referring finally to FIGS. 16 and 17, two examples of connector housing assemblies are illustrated and which may be utilized with any of the afore-described terminal socket assemblies according to the present invention. It should also be noted that the connector housing assemblies provide additional sealing and insulating characteristics to the underlying terminal socket assembly, when employed in a given vehicular application, however the presence of a given type of housing assembly is not necessary according to the broadest dictates of the present invention.

Figure 15:
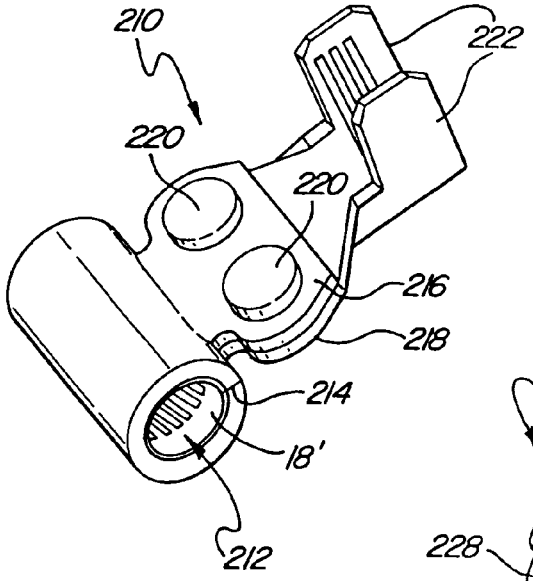
FIG. 15 is an illustration of a button-type terminal sleeve for use in a "T" shape sealed connector according to the present invention.

Referring again to FIG. 16, an illustration is presented of a substantially "T" shaped and sealed connector housing 208 according to the present invention. An associated terminal socket assembly is further illustrated at 210 (see also FIG. 15) and again presents a sleeve 212, within which is installed an appropriately configured spring cage 18'. Compression forming of the cage 18' within the sleeve 212 is further provided by a slit 214 defined between corresponding axial surfaces of the sleeve 212. Bracket portions 216 and 218 integrally extending from the opposing edge locations of the sleeve. A pair of buttons 220 are arranged upon the bracket portions 216 and 218 in engageable fashion and, upon being depressed, compressingly engages the inner diameter of the sleeve about the spring cage. The buttons 220 are further configured so that they will lock into place and to retain the desired friction engaging relationship between the sleeve and spring cage. The locking between 216 and 218 can be done in other fashions such as welding and riveting. Additionally, gripping portions 222 are provided and enable an associated cable end to be secured in a substantially perpendicular manner relative to the extending direction of the sleeve 212.

Referring again to FIG. 16, the overall housing/sealing assembly is again shown and includes a female housing 224 having at least a first 226 and a second 228 open and inserting end established at an angle relative to one another. The female housing 224 defines an open interior for receiving, through the first inserting end 226 and in the manner illustrated, the socket assembly 210, incorporating again the sleeve and interiorly installed spring cage. The gripping portions 222 again extend at an angle relative to the inserting sleeve portion 212, in proximity to the first inserting end 226, and for engaging the cable (such as illustrated at 14 in FIG. 8) within the first inserting end 226.

An elongate and internally hollowed male housing, is illustrated generally at 230, having first 232 and second 234 opposite and open ends. The male housing 230 is engageable with female housing 224 through the opening 228, such that the second end 234 is fully passed through opening 228 of housing 224. The hollow of the male housing 230 is then jacked over "T" terminal sleeve 212. This male housing 230 is locked into female housing 224 through the application of locking fingers (not shown). Upon locking, the male housing 230 is fixed inside female housing 224 and the "T" terminal assembly is fixed and maintained in its desired position. The male housing 230 is usually called terminal position assurance. In application, a male pin (corresponding to male pin 12 in FIG. 8) is biasingly engaged with the assembled sleeve and spring cage 210 contained within the female housing 224.

Additional sealing components include a grommet 236, engageable over the open first inserting end 226 of the female housing 224 and including a grommet retainer 237 with central aperture 239 through which may extend the connecting cable 238. Additional elements include a interfacial seal 240 and seal retainer 242 which are ultrasonically welded to the second inserting end 228 of the female housing 224, and thereby retained in place.

Referring finally to FIG. 17, an alternate housing assembly is illustrated at 248 and which provides a 90 degree (as opposed to "T" shape) sealing arrangement about a previously assembled terminal socket assembly, such as previously disclosed at 162 in FIG. 17). The housing assembly of FIG. 17 largely replicates the construction arrangement previously set forth in the assembly 208 of FIG. 16 and includes a female housing 250 having a first 252 and a second 254 open inserting end established at a perpendicular angle relative to each other. The female housing 250 again defines an open interior for receiving the assembled sleeve and interiorly installed spring cage assembly 162. In this variant, the female connector 250 may be provided in halves (not shown) which are assembled over the socket assembly 168 and ultrasonically welded at an intermediate step.

As with the previous embodiment, the gripping portions 168 of the socket assembly 162 extend at an angle relative to the corresponding sleeve 164. A grommet retainer 270 and subsequent grommet 271 are slid over cable 256. Following this, the cable 256 is then pushed through the "elbow shaped" female housing 250. The cable copper wire end 258, is then crimped to gripping portion 168 of the assembly 162 in the fashion also illustrated at 130 shown in FIG. 8B. Following this, the cable 256 is withdrawn in reverse pulling fashion back through the female housing 250, such that the 90 degree terminal assembly 162 is likewise withdrawn into the female housing 250, and further so that the gripping portions 168 reach the end 254 of housing 250. The gripping portion 168 is purposely designed such that it easily passes the 90 degree turning of the "elbow shaped" housing 250. Following the same fashion previously set forth in FIG. 16, the grommet 271 and grommet retainer 270 (not shown in FIG. 17) are assembled to end 254 of the female housing 250, a terminal position assurance 255 is locked into the housing 250 and to position the terminal assembly 162, and seal 256 and seal and retainer 259 are assembled and ultrasonically welded to the end 252 of female housing 250.

A method for assembling a terminal socket assembly for interconnecting the cables extending from the electrically powered vehicular components is also disclosed, in combination with the afore-described assembly, and includes the steps of providing at least one spring cage blank with first and second extending edges and a plurality of spaced apart and angled beams extending between the extending edges and of forming the spring cage blank into the substantially "hourglass" shaped configuration (according to any of the previously discussed forming variants) and in which the angled beams are again arranged in a substantially helix pattern. Additional steps include providing the substantially tubular shaped and interiorly hollowed sleeve, insertably assembling the formed spring cage into an open end of the sleeve, compressingly actuating the sleeve in biasing and pressured fashion about the spring cage and biasingly engaging with male pin within the assembled spring cage and sleeve and so that the sleeve grips an extending end of a second cable at a further location to electrically communicate the male pin with the cable.

The present invention therefore discloses an improved terminal socket assembly having reduced number of component, minimized joints through electrical power path from male pin through cable at sleeve end which, therefore, increased effective contact area through the electrical power path compared to prior art type pin terminals. The forming process in progression die is used for making cage into hourglass shape. All assembly processes, blanking and forming sleeve 118 are built into same progression die. The use of progression die carriers (see again variants of FIGS. 3A–3D through FIG. 6) in an automation process provides greater economies of scale in manufacture of the socket assemblies.

The socket assembly is also constructed of a simplified two-piece component arrangement and has been found to require less material and forming operations than other conventional assemblies. Finally, the terminal socket assembly has been found to be cost effective in both low and high current applications and can be used to replace existing nut and bolt power connection systems, thus eliminating torque or cross threading problems.

Having described the presently preferred embodiments, it is to be understood that the invention may be otherwise embodied within the scope of the appended claims.

What is claimed is:

1. A method for assembling a terminal socket assembly for interconnecting electrically powered vehicular components with associated input male pin and output cables, said method comprising the steps of:

providing at least one spring cage blank with first and second extending edges and a plurality of spaced apart and angled beams extending between said extending edges;

forming said spring cage blank into a substantially cylindrically shaped configuration and in which said angled beams are arranged in a substantially helix pattern, wherein forming comprises supporting the first and second extending edges of the spring cage blank with first and second mandrels, performing at least one die pressing operation to progressively shape the spring cage blank into a spring cage, and an over-flexing operation to opposite joining ends of the first and second extending edges of the spring cage blank;

providing a substantially tubular shaped and interiorly hollowed sleeve;

insertably assembling said formed spring cage into an open end of said sleeve;

compressingly actuating said sleeve in biasing fashion about said spring cage;

biasingly engaging an male pin said assembled spring cage and sleeve; and said sleeve gripping an extending end of a cable at a further location to electrically communicate the male pin with the cable.

2. The method as described in claim 1, wherein supporting the first and second extending edges of the spring cage blank comprises contacting the first and second extending edges of the spring cage blank with substantially cylindrical projections of the first and second mandrels comprising inwardly curving walls and short cylinders.

3. The method as described in claim 1, said the over-flexing operation comprises rotating the opposite joining ends of said first and second extending edges in opposed directions in order to establish an on-plane configuration during subsequent material spring back of said formed spring cage.

4. The method as described in claim 1, wherein rotating the opposite joining ends of said first and second extending edges comprises rotating a selected end of a substantially formed spring cage at a specified angle in a direction consistent with said angle established by said beams.

5. The method as described in claim 1, further comprising the step of imparting a substantially hourglass shape to said substantially formed spring cage.

6. The method as described in claim 1, further comprising the step of encasing said terminal socket assembly and associated male pin and cable within an angled and sealed connector housing.

7. The method as described in claim 6, further comprising the step of angling gripping portions of said sleeve relative to a direction of said insertably assembled spring cage.

8. The method as described in claim 7, said step of encasing further comprising inserting said assembled sleeve and spring cage into a first inserting end of a female housing, an angularly disposed terminal position assurance engaging a second inserting end of said female housing in communication with said gripping portions.

* * * * *

UNITED STATES PATENT AND TRADEMARK OFFICE

CERTIFICATE OF CORRECTION

PATENT NO. : 7,115,003 B2
APPLICATION NO. : 11/085932
DATED : October 3, 2006
INVENTOR(S) : Zhao et al.

It is certified that error appears in the above-identified patent and that said Letters Patent is hereby corrected as shown below:

On the Title Page, Item (73) Assignee: delete "Alcon" and insert --Alcoa--.

In column 2, line 28, following "which", delete "it so" and insert --is to--.

In column 6, line 62, following "some", delete "affect" and insert --effect--.

In column 15, line 8, line 21 of Claim 1, following "said", delete "formed".

In columns 15 and 16, Claim 3, delete lines 23-2 and insert --The method as described in claim 1, the over-flexing operation further comprising moving the first and second mandrels inward such that the opposite joining ends of said first and second extending edges are over-flexed in opposed directions in order to establish an on-plan configuration during subsequent material spring back of said spring case--.

In column 16, Claim 4, delete lines 3-7 and insert --The method as described in claim 1, wherein the die pressing operation further comprises rotating the opposite joining ends of said first and second extending edges of a substantially formed spring cage at a specified angle in a direction consistent with said angle established by said beams--.

Signed and Sealed this

Sixth Day of November, 2007

JON W. DUDAS
*Director of the United States Patent and Trademark Office*

UNITED STATES PATENT AND TRADEMARK OFFICE

CERTIFICATE OF CORRECTION

PATENT NO. : 7,115,003 B2
APPLICATION NO. : 11/085932
DATED : October 3, 2006
INVENTOR(S) : Zhao et al.

It is certified that error appears in the above-identified patent and that said Letters Patent is hereby corrected as shown below:

In column 6, line 52 following 'some', delete "affect" and insert --effect--.

Signed and Sealed this

Eleventh Day of March, 2008

JON W. DUDAS
*Director of the United States Patent and Trademark Office*